United States Patent [19]

Kennedy et al.

[11] Patent Number: 4,695,035

[45] Date of Patent: Sep. 22, 1987

[54] JACK FOR INSTALLING A MINE STOPPING

[76] Inventors: John M. Kennedy; William R. Kennedy, both of P.O. Box 38, Taylorville, Ill. 62568

[21] Appl. No.: 791,577

[22] Filed: Oct. 25, 1985

[51] Int. Cl.[4] ..... B66F 3/24

[52] U.S. Cl. ..... 254/93 R; 254/133 R; 405/132

[58] Field of Search ..... 254/93 R, 133 R, 133 A, 254/134; 405/290, 132

[56] References Cited

U.S. PATENT DOCUMENTS

| | | | |
|---|---|---|---|
| 2,691,503 | 10/1954 | Bigelow | 254/93 R X |
| 2,721,051 | 10/1955 | Lobbe | 254/93 R |
| 2,917,953 | 12/1959 | Badali | 254/93 R |
| 3,087,626 | 4/1963 | Kimball | 254/93 R X |
| 4,483,642 | 11/1984 | Kennedy et al. | 405/132 |

FOREIGN PATENT DOCUMENTS

| | | | |
|---|---|---|---|
| 1809450 | 7/1970 | Fed. Rep. of Germany | 254/93 R |

*Primary Examiner*—Frederick R. Schmidt
*Assistant Examiner*—Steven P. Schad
*Attorney, Agent, or Firm*—Senniger, Powers, Leavitt and Roedel

[57] ABSTRACT

A jack for installing in a mine a plurality of elongate extensible panels adapted to extend vertically in side-by-side relation from the floor to the roof of a passageway in a mine. Each panel comprises a first elongate member consituting a lower member of the panel and a second elongate member constituting an upper member of the panel, each member having a web and flanges at opposite sides of the web, one of the members having a telescoping sliding fit in the other. The upper member of each panel has a head at its upper end and the lower member of each panel has a foot at its lower end. The jack comprises a base adapted to fit between the flanges of a lower panel member and engage the foot of the lower panel member, an extensible member having a crosshead at its upper end adapted to fit between the flanges of an upper panel member and engage the head of the upper panel member, a guide extending up from the base guiding the extensible member for up and down movement relative to the guide and the base, a hydraulic jack cylinder extending up from the base coaxially with the guide having a lift member movable up and down for raising and lowering the extensible member, a hydraulic pump on the base for pumping hydraulic fluid to the cylinder for moving the lift member and the extensible member upwardly, and a mechanism for operating the pump comprising a handle pivoted on the guide at a level convenient for an operator and a link from the handle to the pump.

17 Claims, 6 Drawing Figures

JACK FOR INSTALLING A MINE STOPPING

BACKGROUND OF THE INVENTION

This invention relates to a jacking mechanism, and more particularly to a jack for installing a mine stopping of the type comprising a plurality of metal panels.

A jack of this invention is especially useful in installing a mine stopping of the type shown and described in applicants' U.S. Pat. No. 4,483,642, which stopping comprises a plurality of elongate extensible panels extending vertically in side-by-side relation from the floor to the roof of a passageway in a mine. The aforesaid patent discloses a jack suitable for installing such a stopping, and while the operation of this jack has been generally satisfactory, the jack of the present invention represents an improvement thereover.

SUMMARY OF THE INVENTION

Among the several objects of this invention may be noted the provision of an improved jack for installing a mine stopping of the type described above; the provision of such a jack which is capable of infinite adjustment within its range of extension; the provision of such a jack which is efficient in operation to facilitate use; the provision of such a jack which is compact in design; the provision of such a jack wherein the lifting force may be released without first extending the jack; and the provision of such a jack which is adapted to hold a panel of a mine stopping in proper position with respect to the jack during installation of the panel thereby leaving both hands free to operate the jack.

In general, an improved jack of the present invention is useful for installing in a mine a plurality of elongate extensible panels adapted to extend vertically in side-by-side relation from the floor to the roof of a passageway in the mine, each panel comprising a first elongate member constituting a lower member of the panel adapted for engagement of its lower end with the floor of the passageway, and a second elongate member constituting an upper member of the panel adapted for engagement of its upper end with the roof of the passageway. Each of the panel members is a sheet metal member of channel shape in cross section having a web and flanges at opposite sides of the web, each flange having an inturned portion at its outer edge extending generally parallel to the web. One of said members has a telescoping sliding fit in the other with the webs of the members in engagement, the one member constituting the inner member and the other constituting the outer member of the panel. A plurality of the panels are adapted to be installed in a passageway with the side flanges of the outer members generally in engagement, the upper member of each panel having a head at its upper end, the lower member of each panel having a foot at its lower end. The jack comprises a base adapted to fit between the flanges of a lower panel member and engage the foot of said lower panel member, an extensible member having means at its upper end adapted to fit between the flanges of an upper panel member and engage the head of said upper panel member, guide means extending up from the base guiding the extensible member for up and down movement relative to said guide means and the base, a hydraulic jack cylinder extending up from the base coaxially with the guide means having a lift member movable up and down for raising and lowering the extensible member, a hydraulic pump on the base for pumping hydraulic fluid to the cylinder for moving the lift member and the extensible member upwardly, and means for operating the pump comprising a handle pivoted on the guide means at a level convenient for an operator and a link from the handle to the pump.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
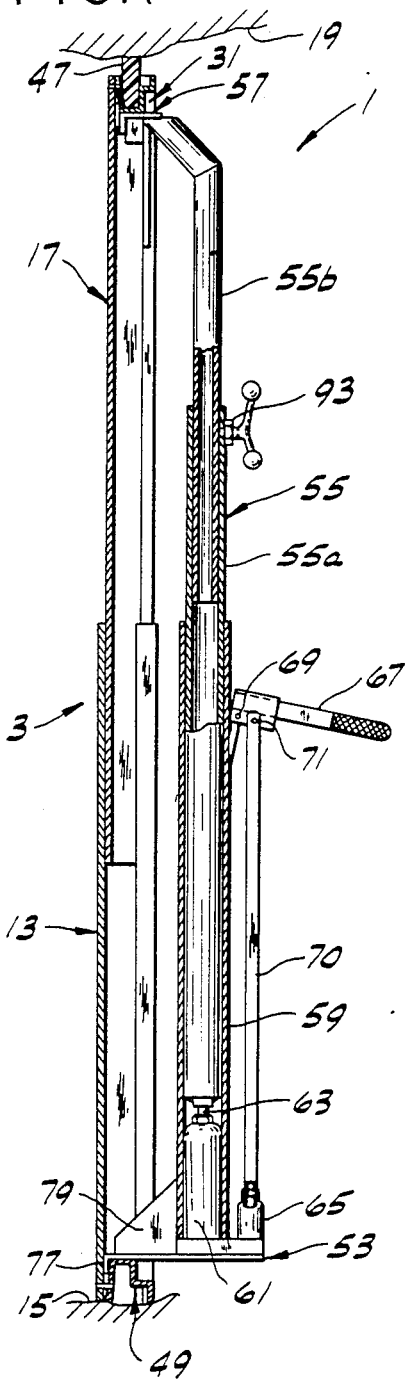
FIG. 1 is a side elevation of a jack of the present invention as it is used to install an extensible panel of a mine stopping, portions of the jack being broken away to illustrate details.

Referring now to the drawings, there is generally indicated at 1 an improved jack of the present invention for installing in a mine a plurality of elongate extensible panels (one such panel is indicated in its entirety at 3 in the drawings) adapted to extend vertically in side-by-side relation from the floor to the roof of a passageway in the mine. These panels are described in detail in our U.S. Pat. No. 4,483,642.

Figure 4:
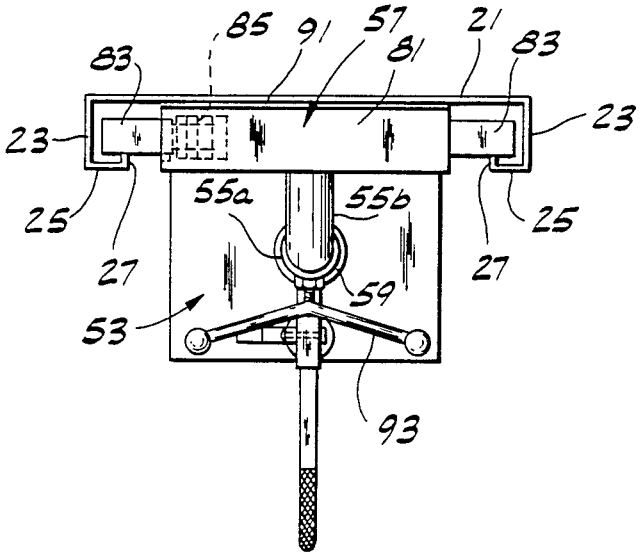
FIG. 4 is a top plan of FIG. 3 with the head of the panel removed to illustrate the crosshead of the jack.

In general, however, each panel 3 comprises a first elongate member 13 constituting a lower member of the panel adapted for engagement of its lower end with the floor 15 of the passageway and a second elongate member 17 constituting an upper member of the panel adapted for engagement of its upper end with the roof 19 of the passageway. Each panel member 13, 17 is a sheet metal member of channel shape in cross section having a web 21 and flanges, each designated 23, at opposite sides of the web (see FIG. 4). Each flange has an inturned portion 25 at its outer edge extending generally parallel to the web and a lip 27 at the inner edge of the inturned portion extending toward the web. The upper panel member 17 is shown as having a telescoping fit in the lower panel member 13 (although this could be reversed to have the lower panel member telescoped in the upper panel member), the webs 21 of the members being in sliding engagement.

Figure 6:
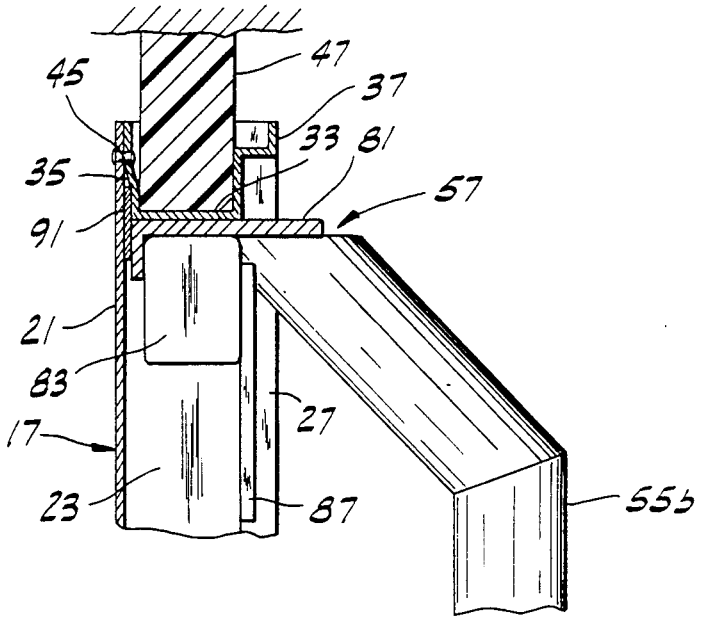
FIG. 6 is an enlarged portion of FIG. 1 illustrating the jack in engagement with the head of the panel.

The upper member of the panel 3 has a head generally indicated at 31 at its upper end generally of channel shape in transverse cross section having a web 33, a first flange 35 extending up from the edge of the web of the head at the inside face of the web 21 of the upper panel member, and a stepped second flange 37 extending up from the other edge of the web 33 (see FIG. 6). The head 31 is preferably of relatively thin-gauge sheet metal and is secured to the upper panel member 17 at its upper end with the ends of the head spaced from the side flanges 23 of the upper panel member by suitably attaching the first flange 35 of the head to the web 21 of the upper panel member at the upper corners of the first flange 35, the areas of attachment being generally designated 45. As illustrated in FIG. 6, a sealing member 47 is pocketed in the head 31 and extends up out of the upper end of the upper panel member 17 for engagement with the roof 19 of the passageway. sageway.

Figure 5:
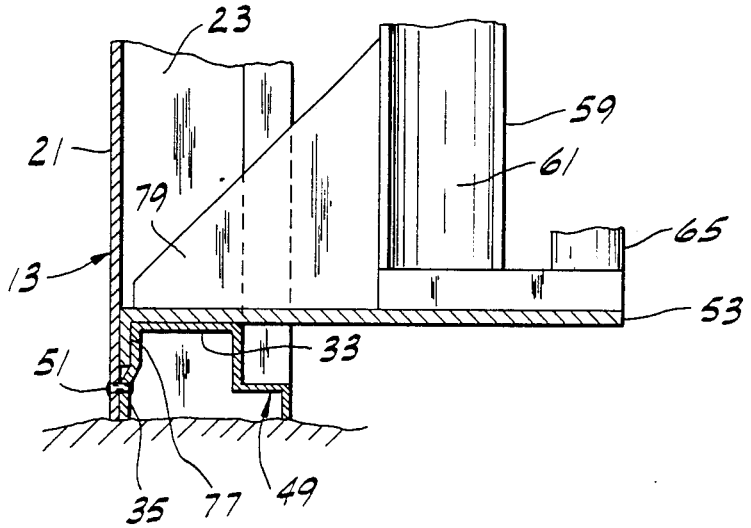
FIG. 5 is an enlarged portion of FIG. 1 illustrating the jack in engagement with a foot of the panel.

The lower member 13 of each panel has a foot 49 at its lower end having a configuration and construction similar to that of the head 31. The foot is secured in the lower panel member at its lower end with the ends of the foot by attachment of the first flange of the foot to the web 21 of the lower panel member at the lower corners of the first flange of the foot, as indicated at 51 in FIG. 5.

As stated above, reference may be made to our U.S. Pat. No. 4,483,642 for additional detail regarding the construction of the panel 3 and a method of assembling a plurality of such panels in side-by-side relation to form a mine stopping.

Figure 2:
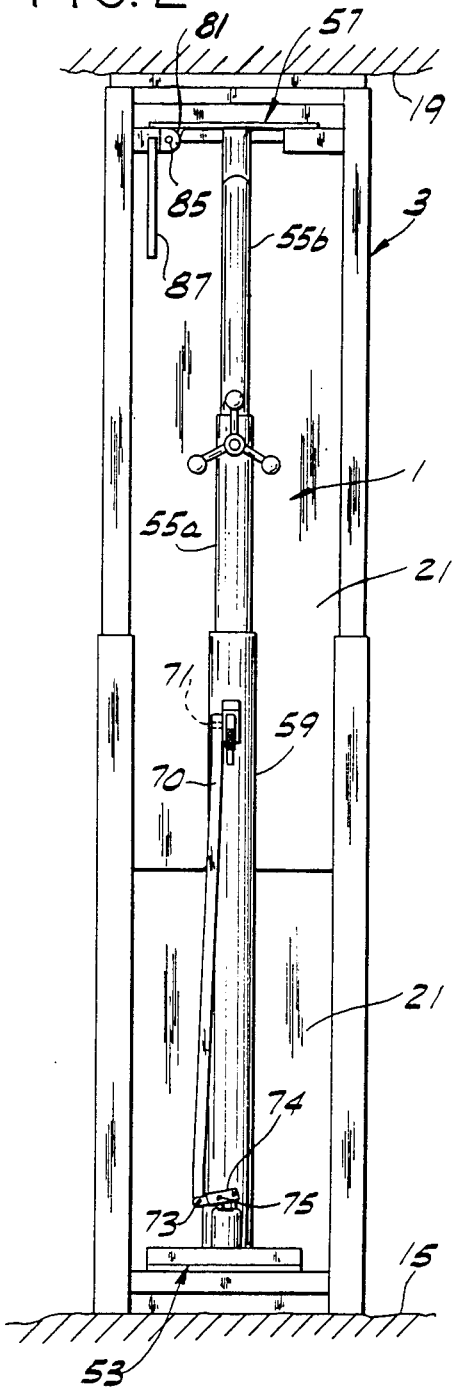
FIG. 2 is a right side elevation of FIG. 1.

As best illustrated in FIGS. 1 and 2, the jack 1 of the present invention is a hydraulic jack (unlike the ratchet jack disclosed in our aforementioned patent) comprising a base 53 adapted to fit between the flanges 23 of a lower panel member 13 and to engage the foot 49 of the member, an extensible member 55 having a crosshead generally indicated at 57 at its upper end adapted to fit between the flanges 23 of an upper panel member 17 and to engage the head 31 of the upper panel member, and guide means comprising a guide tube 59 extending vertically upwardly from the base guiding the extensible member 55 for up and down movement relative to the guide tube and the base. The jack also includes a hydraulic jack cylinder 61 extending up from the base inside the guide tube and generally coaxially therewith having a lift member or plunger 63 movable up and down for raising and lowering the extenible member (FIG. 1). Also mounted on the base adjacent the guide tube is a hydraulic pump 65 for pumping hydraulic fluid to the cylinder 61 for moving the plunger and the extensible member 55 upwardly. The pump is manually operable by means of a lever-type handle 67 pivoted at 69 on the guide tube at a level convenient for an operator. The handle 67 is connected to the piston of the pump 65 by linkage comprising a vertical link 70 pinned at its upper end at 71 to the handle and at its lower end at 73 to a bar 74 connected to the pump piston at 75, the arrangement being such that swinging of the handle downwardly operates to raise the extensible member 55.

The base 53 of the jack comprises a flat metal plate which is adapted to bear directly on the web 33 of the foot 49 of the lower panel member 13, and a depending lip 77 at the outer edge of the plate receivable between the first flange 35 of the foot and the web 21 of the lower panel member, the foot being sufficiently flexible away from web 21 to permit insertion of the lip 77 into this position. Tip 77 (consitituting retainer means) serves to hold the base 53 of the jack against outward movement from between flanges 23 of the lower panel member and in proper position with respect to the foot of the lower panel member during installation of the panel member. A gusset 79 is provided between the base and the guide tube to reinforce the structure.

Figure 3:
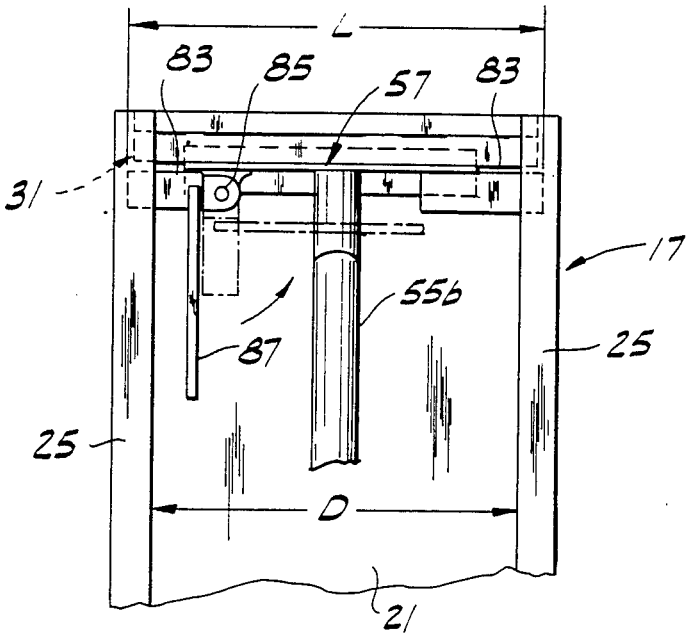
FIG. 3 is an enlarged portion of FIG. 2 showing a crosshead at the upper end of the jack in position below a head of the panel.

The crosshead 57 at the upper end of the extensible member 55 comprises a bar 81 (FIG. 4) of angle bar stock having a lug 83 extending endwise from each end of the bar. The crosshead 57 is contractible in length to permit insertion of the crosshead between the lips 27 of the flanges 23 of the upper panel member to a position (FIG. 6) below the head 31 of the upper panel member, and extensible to a length L greater than the distance D between the lips 27 of flanges 23. More specifically, one lug 83 (the left lug as viewed in FIG. 4), is pivoted on the bar by means of a spring hinge 85 for swinging from an extended position (shown in solid lines in FIG. 3) in which it extends generally endwise with respect to the crosshead to a retracted position (shown in dashed lines in FIG. 3) in which it is swung down from the crosshead thereby to shorten the effective length of the crosshead. A lever 87 is provided for swinging the lug down to its stated retracted position. The spring hinge 85 biases the lug toward its extended position. When the hinged lug 83 is in its extended position, the crosshead is engageable with the lips 27 of the flanges 23 of the upper panel member for maintaining the crosshead in its FIG. 6 position below web 33 of the head 31.

Extending up from the outer edge of the bar 81 is a lip 91 receivable between the first flange 35 of the head 31 and the web 21 of the upper panel member, the head being sufficiently flexible away from web 21 to permit insertion of the lip 91 into this position. Tip 91 (constituting retainer means) assists in holding the crosshead against outward movement from between the flanges 23 of the upper panel member and in proper position with respect to the head of the upper panel member during installation of the panel member.

The extensible member 55 comprises a first tubular section **55*a* constituting a lower tubular section having a telescoping sliding fit inside the guide tube 59, a second tubular section 55*b* constituting an upper tubular section having a telescoping sliding fit within the lower tubular section for providing rough adjustment of the length of the extensible member, and means comprising a set screw 93 for locking the upper and lower tubular sections in adjusted position with respect to one another. The upper end of the upper tubular section 55*b* carrying the crosshead 57 is bent at about a 45° angle from the vertical, the arrangement being such that lips 77 and 91 on the base and crosshead, respectively, lie generally in the same vertical plane. The extensible member 55 and guide tube 59** are circular in horizontal cross section to permit relative rotation therebetween, which is useful during installation of a panel member, as described below.

In installing a stopping, the length of the extensible member 55 is roughly adjusted to a length somewhat less than the distance from the floor to the roof of a passageway to be stopped by telescopically sliding the upper section **55*b* of the extensible member relative to the lower section 55*a* and then tightening set screw 93 to secure the two sections relative to one another. Having done this, the base 53 of the jack is engaged with the lower panel member 13 as shown in FIG. 1, that is, with the base resting on the web 33 of the foot 49 of the lower panel member 13 and the lip 77 of the base inserted between the web 21 of the lower panel member and the first flange 35 of the foot 49. The upper panel member 17 is then manually extended relative to the lower panel member to a height at which the crosshead 57 is adapted for engagement with the head 31. To position the crossbar below the head, lug 83 is swung down to its retracted position (shown in dashed lines in FIG. 3) and the extensible member rotated slightly in the guide tube 59 thereby to enable the crosshead to be inserted at an angle, right lug first (as viewed in FIG. 3), between the inturned portions 25 of the flanges 23 of the upper panel member 17 to a position in which the crosshead is disposed squarely between the flanges 23 below the head 31 of the upper panel member. The hinged lug 83 is then released to swing up to its extended position, withdrawal of the crosshead from between the flanges 23 of the upper panel thus being prevented by the engagement of the lugs 83 with the lips 27 of the upper panel member. With the upper panel member thus held on the crossbar, an operator is free to use both hands to operate the jack, hold the panel in position, etc. Insertion of the lip 91 at the outer edge of the crossbar to a position between the web 21 of the upper panel member and the first flange 35 of the head 31** also assists in maintaining the crosshead in proper position with respect to the head.

With the jack in engagement with the panel members as described above, the extensible member 55 is extended by pivoting handle 67 up and down to force the lower panel member down and the upper panel member up into sealing engagement with the floor and roof, respectively, of the passageway. Following the extension of the upper and lower panels 13 and 17 of a panel 3, the jack is removed by releasing the hydraulic pressure and reversing the steps enumerated above. For additional details regarding the installation of a plurality of panels 3 in side-by-side relation, reference may be made to our aforementioned patent.

It will be observed from the foregoing that the jack 1 of this invention represents an improvement over the design shown in U.S. Pat. No. 4,483,642, noting particularly that the lifting force developed by the jack on the extensible member 55 is in vertical alignment with the reaction point of the jack through the central axis of the hydraulic cylinder 61, which is a more efficient mechanical design. Moreover, since the jack is hydraulic, it is capable of infinite adjustment over a relatively wide range (as opposed to a ratchet-type jack which is adjustable only in discrete increments) and may be lowered without first raising the jack, which is advantageous in that this avoids unduly stressing the stopping and maintains the ability of the stopping to reseal against the floor and roof of a passageway. The jack of the present invention is also of more compact design, lighter in weight, and requires less manual effort to operate.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A jack for installing in a mine a plurality of elongate extensible panels adapted to extend vertically in side-by-side relation from the floor to the roof of a passageway in a mine, each panel comprising a first elongate member constituting a lower member of the panel adapted for engagement of its lower end with the floor of the passageway, and a second elongate member constituting an upper member of the panel adapted for engagement of its upper end with the roof of the passageway, each of said panel members being a sheet metal member of channel shape in cross section having a web and flanges at opposite sides of the web, each flange having an inturned portion at its outer edge extending generally parallel to the web, one of said members having a telescoping sliding fit in the other with the webs of the members in engagement, the one member constituting the inner member and the other constituting the outer member of the panel, a plurality of the panels being adapted to be installed in a passageway with the side flanges of the outer members generally in engagement, the upper member of each panel having a head at its upper end, the lower member of each panel having a foot at its lower end, said jack comprising:

a base adapted to fit between the flanges of a lower panel member and engage the foot of said lower panel member;

an extensible member having means at its upper end adapted to fit between the flanges of an upper panel member and engage the head of said upper panel member;

guide means extending up from the base guiding said extensible member for up and down movement relative to said guide means and the base;

a hydraulic jack cylinder extending up from the base coaxially with the guide means having a lift member movable up and down for raising and lowering said extensible member;

a hydraulic pump on the base for pumping hydraulic fluid to said cylinder for moving the lift member and said extensible member upwardly; and means for operating the pump comprising a handle pivoted on the guide means at a level convenient for an operator and a link from the handle to the pump, said means at the upper end of said extensible member comprising a crosshead contractible in length for insertion of the crosshead between the flanges of said upper panel member to a position below the head of said upper panel member, and extensible to a length greater than the distance between said flanges whereby the crosshead is adapted for engagement with the flanges to maintain the crosshead in said position below the head of the upper panel member.

2. A jack as set forth in claim 1 wherein said extensible member is rotatable with respect to the guide tube for assisting in the insertion of the crosshead to said position below the head of said upper panel member.

3. A jack as set forth in claim 1 wherein said crosshead has a lug pivoted at one end thereof for pivoting from an extended position in which it extends generally endwise with respect to the crosshead to a retracted position in which it is swung down from the crosshead thereby to shorten the effective length of the crosshead.

4. A jack as set forth in claim 3 wherein said lug is spring-biased toward said extended position.

5. A jack for installing in a mine a plurality of elongate extensible panels adapted to extend vertically in side-by-side relation from the floor to the roof of a passageway in a mine, each panel comprising a first elongate member constituting a lower member of the panel adapted for engagement of its lower end with the floor of the passageway, and a second elongate member constituting an upper member of the panel adapted for engagement of its upper end with the roof of the passageway, each of said panel members being a sheet metal member of channel shape in cross section having a web and flanges at opposite sides of the web, each flange having an inturned portion at its outer edge extending generally parallel to the web, one of said members having a telescoping sliding fit in the other with the webs of the members in engagement, the one member constituting the inner member and the other constituting the outer member of the panel, a plurality of the panels being adapted to be installed in a passageway with the side flanges of the outer members generally in engagement, the upper member of each panel having a head at its upper end, the lower member of each panel having a foot at its lower end, said jack comprising:

a base adapted to fit between the flanges of a lower panel member and engage the foot of said lower panel member;

an extensible member having means at its upper end adapted to fit between the flanges of an upper panel member and engage the head of said upper panel member;

guide means extending up from the base guiding said extensible member for up and down movement relative to said guide means and the base;

a hydraulic jack cylinder extending up from the base coaxially with the guide means having a lift member movable up and down for raising and lowering said extensible member;

a hydraulic pump of the base for pumping hydraulic fluid to said cylinder for moving the lift member and said extensible member upwardly; and means for operating the pump comprising a handle pivoted on the guide means at a level convenient for an operator and a link from the handle to the pump, said means at the upper end of said extensible member comprising a crosshead adapted to be inserted inwardly to a position between the flanges of an upper panel member for engagement with the head of said panel member, said crosshead having a lip extending upwardly therefrom for insertion between the web of said upper panel member and said head thereby to assist in holding the crosshead in proper position with respect to the upper panel member against outward movement from between the flanges of the upper panel member.

6. A jack as set forth in claim 5 further comprising a lip depending from said base for insertion between the web of a lower panel member and said foot thereby to assist in holding the base in proper position with respect to the lower panel member against outward movement from between the flanges of the lower panel member.

7. A jack as set forth in claim 5 wherein said crosshead is contractible in length for insertion of the crosshead between the flanges of said upper panel member to a position below the head of said upper panel member, and extensible to a length greater than the distance between said flanges whereby the crosshead is adapted for engagement with the flanges to maintain the crosshead in said position below the head of the upper panel member.

8. A jack as set forth in claim 7 wherein said extensible member is rotatable with respect to the guide means for assisting in the insertion of the crosshead to said position below the head of said upper panel member.

9. A jack as set forth in claim 7 wherein said crosshead has a lug pivoted at one end thereof for pivoting form an extended position in which it extends generally endwise with respect to the crosshead to a retracted position in which it is swung down from the crosshead thereby to shorten the effective length of the crosshead.

10. A jack as set forth in claim 9 wherein said lug is spring-biased toward said extended position.

11. A jack as set forth in claim 5 wherein said extensible member is freely rotatable in the guide means relative to the base.

12. A jack as set forth in claim 11 wherein said extensible member comprises a first tubular section constituting a lower tubular section having a telescoping sliding fit inside the guide tube, a second tubular section constituting an upper tubular section having a telescoping sliding fit with said lower tubular section for providing adjustment of the length of said extensible member, and means for locking said upper and lower tubular sections in adjusted position with respect to one another.

13. A jack as set forth in claim 12 wherein said upper and lower tubular sections are generally circular in cross section.

14. A jack for installing in a mine a plurality of elongate extensible panels adapted to extend vertically in side-by-side relation from the floor to the roof of a passageway in a mine, each panel comprising a first elongate member constituting a lower member of the panel adapted for engagement of its lower end with the floor of the passageway, and a second elongate member constituting an upper member of the panel adapted for engagement of its upper end with the roof of the passageway, each of said panel members being a sheet retal member of channel shape in cross section having a web and flanges at opposite sides of the web, each flange having an inturned portion at its outer edge extending generally parallel to the web, one of said members having a telescoping sliding fit in the other with the webs of the members in engagement, the one member constituting the inner member and the other constituting the outer member of the panel, a plurality of the panels being adapted to be installed in a passageway with the side flanges of the outer members generally in engagement, the upper member of each panel having a head at its upper end, the lower member of each panel having a foot at its lower end, said jack comprising:

a base adapted to fit between the flanges of a lower panel member and engage the foot of said lower panel member;

an extensible member having a crosshead at its upper end adapted to be inserted inwardly to a position between the flanges of an upper panel member and to engage the head of said panel member, said crosshead being engageable with the flanges of the upper panel member for holding the upper end of the extensible member against outward movement from between the flanges of the upper panel member;

a guide tube affixed to the base and extending up from the base guiding said extensible member for up and down movement relative to said guide tube and the base;

a hydraulic jack cylinder extending up from the base inside the guide tube and generally coaxially with the guide tube, said jack cylinder having a lift member movable up and down for raising and lowering said extensible member;

a hydraulic pump on the base for pumping hydraulic fluid to said cylinder for moving the lift member and said extensible member upwardly;

means for operating the pump comprising a handle pivoted on the guide tube at a level convenient for an operator and a link from the handle to the pump;

and retainer means extending up from the crosshead for insertion between the web of the upper panel member and said head thereby to assist in holding the upper end of the extensible member against outward movement from between the flanges of the upper panel member.

15. A jack set forth in claim 14 wherein said retainer means on the crosshead comprises a vertical lip on the crosshead extending lenthwise of the crosshead.

16. A jack as set forth in claim 16 further comprising retainer means depending from the base for insertion between the web of the lower panel member and said foot thereby to assist in holding the base of the jack against outward movement from between the flanges of the lower panel member.

17. A jack as set forth in claim 16 wherein said retainer means on the base comprises a depending vertical lip.

* * * * *

UNITED STATES PATENT AND TRADEMARK OFFICE

CERTIFICATE OF CORRECTION

PATENT NO. : 4,695,035

DATED : September 22, 1987

INVENTOR(S) : John M. Kennedy and William R. Kennedy

It is certified that error appears in the above—identified patent and that said Letters Patent is hereby corrected as shown below:

Column 6, claim 2, line 40, "guide tube" should read --guide means--. Column 8, claim 12, line 2, "guide tube" should read --guide means--. Column 7, claim 9, line 58, "form an extended" should read --from an extended--. Column 8, claim 14, line 20, "a sheet retal" should read --a sheet metal--. Column 9, claim 16, line 4, "in claim 16" should read --in claim 14--.

Signed and Sealed this

Second Day of May, 1989

*Attest:*

*Attesting Officer*

DONALD J. QUIGG

*Commissioner of Patents and Trademarks*